US008714950B2

(12) United States Patent
Moro et al.

(10) Patent No.: US 8,714,950 B2
(45) Date of Patent: May 6, 2014

(54) SCROLL COMPRESSOR HAVING TIP SEALS OF DIFFERENT LENGTHS HAVING DIFFERENT THICKNESS OR WIDTHS

(75) Inventors: Tomohisa Moro, Aichi (JP); Norio Hioki, Aichi (JP); Koji Terasaki, Aichi (JP); Koryo Shibahara, Aichi (JP); Tetsuzo Ukai, Aichi (JP); Katsuhiro Fujita, Aichi (JP); Takayuki Kuwahara, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 327 days.

(21) Appl. No.: 13/139,213

(22) PCT Filed: May 14, 2010

(86) PCT No.: PCT/JP2010/058174

§ 371 (c)(1),
(2), (4) Date: Jul. 8, 2011

(87) PCT Pub. No.: WO2010/137468

PCT Pub. Date: Dec. 2, 2010

(65) Prior Publication Data

US 2011/0286871 A1 Nov. 24, 2011

(30) Foreign Application Priority Data

May 27, 2009 (JP) ..... 2009-127782

(51) Int. Cl.
*F03C 2/00* (2006.01)
*F03C 4/00* (2006.01)
*F04C 2/00* (2006.01)

(52) U.S. Cl.
USPC ..... 418/55.4; 418/55.2; 418/142

(58) Field of Classification Search
USPC ..... 418/55.1–55.6, 57, 104, 140, 142
See application file for complete search history.

(56) References Cited

U.S. PATENT DOCUMENTS

| | | | |
|---|---|---|---|
| 7,344,365 | B2 | 3/2008 | Takeuchi et al. |
| 2005/0053507 | A1 | 3/2005 | Takeuchi et al. |
| 2007/0065325 | A1 | 3/2007 | Takeuchi et al. |
| 2009/0280019 | A1 | 11/2009 | Sato et al. |

FOREIGN PATENT DOCUMENTS

| | | | |
|---|---|---|---|
| JP | 6-137284 | A | 5/1994 |
| JP | 7-158568 | A | 6/1995 |
| JP | 3046523 | B2 | 5/2000 |
| JP | 2001-221176 | A | 8/2001 |
| JP | 2003-106269 | A | 4/2003 |
| JP | 2005-61295 | A | 3/2005 |
| JP | 2008-248758 | A | 10/2008 |
| WO | 2008/075415 | A1 | 6/2008 |

OTHER PUBLICATIONS

International Search Report of PCT/JP2010/058174, mailing date Aug. 10, 2010.

*Primary Examiner* — Theresa Trieu
(74) *Attorney, Agent, or Firm* — Westerman, Hattori, Daniels & Adrian, LLP

(57) ABSTRACT

A scroll compressor is provided that can reliably prevent a situation in which a product whose performance is degraded due to misassembly of a tip seal is shipped. In the scroll compressor, tip seals of different lengths are embedded in tip surfaces of a fixed spiral wrap of a fixed scroll and an orbiting spiral wrap of an orbiting scroll. Among the tip seals, thicknesses of the shorter tip seals are made thicker than thicknesses of the longer tip seals, and depths of seal grooves in which the tip seals are embedded, respectively, are formed to different depths in correspondence with the thicknesses of the respective tip seals.

8 Claims, 3 Drawing Sheets

SCROLL COMPRESSOR HAVING TIP SEALS OF DIFFERENT LENGTHS HAVING DIFFERENT THICKNESS OR WIDTHS

TECHNICAL FIELD

The present invention relates to a scroll compressor in which tip seals are embedded in tip surfaces of spiral wraps of a fixed scroll and an orbiting scroll, respectively.

BACKGROUND ART

In a scroll compressor in which a compression chamber is formed by causing a pair of a fixed scroll and an orbiting scroll to engage, in order to seal tip clearances that are formed between tip surfaces of spiral wraps of the fixed scroll and the orbiting scroll and bottom surfaces of spiral wraps of the opposing scroll, seal grooves are provided in the tip surfaces of the spiral wraps and tip seals are embedded in the seal grooves.

Various configurations are adopted when embedding the tip seals. These include a configuration in which a tip seal to be embedded in the spiral wrap of the fixed scroll and a tip seal to be embedded in the spiral wrap of the orbiting scroll have the same configuration, that is, the lengths in the spiral direction as well as the thicknesses and widths of the tip seals are the same, and a configuration in which, to avoid interference with a discharge port provided in the fixed scroll, an inner circumferential end side of a tip seal to be embedded in the orbiting spiral wrap is shortened, and to avoid interference with an outer circumference of an end plate of the orbiting scroll, an outer circumferential end side of a tip seal to be embedded in the fixed spiral wrap is shortened.

As described in PTL 1, a configuration may also be adopted in which a tip seal that has a thickness that is less than the depth of a seal groove is embedded, or a tip seal that has a thickness that exceeds the depth of a seal groove is embedded. Further, a configuration is sometimes adopted in which the width of a tip seal is broadened at an inner circumferential end side to correspond with a spiral wrap in which the wrap width is broadened at an inner circumferential end side.

CITATION LIST

Patent Literature

{PTL 1} The Publication of Japanese Patent No. 3046523

SUMMARY OF INVENTION

Technical Problem

With respect to the aforementioned tip seals, when the configuration of a tip seal to be embedded in a fixed scroll is the same as the configuration of a tip seal to be embedded in an orbiting scroll, although a situation in which a tip seal is incorrectly assembled can not occur, if the lengths in a spiral direction of the tip seal to be embedded in the fixed scroll and the tip seal to be embedded in the orbiting scroll are different, there is a possibility that the short tip seal will be mistakenly embedded in a long seal groove. That is, although a case will not arise in which the long tip seal is embedded in place of the short tip seal in a seal groove, there is space for the short tip seal to be embedded in place of the long tip seal, and hence the possibility that a tip seal may be mistakenly embedded remains. This also applies to the case of the tip seal described in PTL 1.

Even if a tip seal is incorrectly assembled as described above, a hindrance does not arise in terms of the operation of the scroll compressor, and the misassembly can not be detected even when checking the rotational torque in the assembly process. Hence, a situation may occur in which the relevant scroll compressor is shipped in that state. However, since there is a defect in the function of the tip seal of the relevant scroll compressor, a large amount of gas will leak from the scroll compressor and a corresponding decrease in the compression performance thereof is unavoidable. Hence, there is a risk that the scroll compressor will lose its reliability as a product.

The present invention has been made in light of the foregoing circumstances, and it is an object thereof to provide a scroll compressor that can reliably prevent a situation in which a product whose performance is degraded due to misassembly of a tip seal is shipped.

Solution to Problem

To solve the above-described problem, the scroll compressor according to the present invention employs the following solutions.

Specifically, a scroll compressor according to a first aspect of the present invention is a scroll compressor in which tip seals of different lengths are embedded in tip surfaces of a fixed spiral wrap of a fixed scroll and an orbiting spiral wrap of an orbiting scroll, wherein, among the tip seals, a thickness of a shorter tip seal is made thicker than a thickness of a longer tip seal, and depths of seal grooves in which the respective tip seals are embedded are formed to different depths in correspondence with the thicknesses of the respective tip seals.

According to the above described first aspect of the present invention, among tip seals of different lengths that are embedded in tip surfaces of a spiral wrap of a fixed scroll and a spiral wrap of an orbiting scroll, the thickness of a shorter tip seal is made thicker than the thickness of a longer tip seal, and depths of seal grooves in which the respective tip seals are embedded are formed to different depths in correspondence with the thicknesses of the respective tip seals. Hence, even if a short tip seal is mistakenly embedded in a seal groove into which a long tip seal is to be embedded, the tip seal will protrude from the seal groove and contact with an opposing scroll, and consequently the mistaken embedding can be detected as a misassembly when checking the rotational torque in the assembly process. Accordingly, a situation in which a product whose performance is degraded due to misassembly of a tip seal is shipped can be reliably prevented, and thus reliability can be improved.

Further, according to a second aspect of the scroll compressor of the present invention there is provided a scroll compressor in which tip seals of different lengths are embedded in tip surfaces of a fixed spiral wrap of a fixed scroll and an orbiting spiral wrap of an orbiting scroll, wherein, among the tip seals, a width of a shorter tip seal is made wider than a width of a longer tip seal, and widths of seal grooves in which the respective tip seals are embedded are formed to different widths in correspondence with the widths of the respective tip seals.

According to the second aspect of the present invention described above, among tip seals of different lengths that are embedded in tip surfaces of a spiral wrap of a fixed scroll and a spiral wrap of an orbiting scroll, the width of a shorter tip seal is made wider than the width of a longer tip seal, and widths of seal grooves into which the respective tip seals are embedded are formed to different widths in correspondence with the widths of the respective tip seals. Hence, a case does not occur in which the tip seal that has the shorter length and wider width is embedded into a seal groove with a narrow width into which the longer tip seal is to be embedded, and thus a misassembly can be prevented. Accordingly, a situation in which a product whose performance is degraded due to misassembly of a tip seal is shipped can be reliably prevented, and thus reliability can be improved.

Furthermore, according to a third aspect of the scroll compressor of the present invention there is provided a scroll compressor in which step portions are provided at predetermined positions in a spiral direction of a tip surface and a bottom surface of a fixed spiral wrap of a fixed scroll and an orbiting spiral wrap of an orbiting scroll, respectively, and taking the step portions as boundaries, a wrap height of an outer circumferential side is made higher than a wrap height of an inner circumferential side, and tip seals of different lengths are embedded in tip surfaces of the inner circumferential side wrap and outer circumferential side wrap of the respective spiral wraps, wherein, among the tip seals, a thickness of a shorter tip seal is made thicker than a thickness of a longer tip seal, and depths of seal grooves in which the respective tip seals are embedded are formed to different depths in correspondence with the thicknesses of the respective tip seals.

According to the above described third aspect of the present invention, in a stepped scroll compressor in which step portions are provided at predetermined positions in a spiral direction of a tip surface and a bottom surface of a spiral wrap of a fixed scroll and a spiral wrap of an orbiting scroll, respectively, among tip seals of different lengths that are embedded in tip surfaces of an inner circumferential side wrap and an outer circumferential side wrap of each spiral wrap, a thickness of a shorter tip seal is made thicker than a thickness of a longer tip seal, and depths of seal grooves in which the respective tip seals are embedded are formed to different depths in correspondence with the thicknesses of the respective tip seals. Hence, even if a shorter tip seal is mistakenly embedded in a seal groove in which a longer tip seal is to be embedded, the tip seal will protrude from the seal groove and contact with an opposing scroll, and consequently the mistaken embedding can be detected as a misassembly when checking the rotational torque in the assembly process. Accordingly, in a so-called "stepped scroll compressor" also, a situation in which a product whose performance is degraded due to misassembly of a tip seal is shipped can be reliably prevented, and thus reliability can be improved.

Further, according to a fourth aspect of the scroll compressor of the present invention there is provided a scroll compressor in which step portions are provided at predetermined positions in a spiral direction of a tip surface and a bottom surface of a fixed spiral wrap of a fixed scroll and an orbiting spiral wrap of an orbiting scroll, respectively, and taking the step portions as boundaries, a wrap height of an outer circumferential side is made higher than a wrap height of an inner circumferential side, and tip seals of different lengths are embedded in tip surfaces of the inner circumferential side wrap and outer circumferential side wrap of the respective spiral wraps, wherein, among the tip seals, a width of a shorter tip seal is made wider than a width of a longer tip seal, and widths of seal grooves in which the respective tip seals are embedded are formed to different widths in correspondence with the widths of the respective tip seals.

According to the above described fourth aspect of the present invention, in a stepped scroll compressor in which step portions are provided at predetermined positions in a spiral direction of a tip surface and a bottom surface of a spiral wrap of a fixed scroll and a spiral wrap of an orbiting scroll, respectively, among tip seals of different lengths that are embedded in tip surfaces of an inner circumferential side wrap and an outer circumferential side wrap of each spiral wrap, a width of a shorter tip seal is made wider than a width of a longer tip seal, and widths of seal grooves in which the respective tip seals are embedded are formed to different widths in correspondence with the widths of the respective tip seals. Hence, a case does not occur in which the tip seal that has the shorter length and wider width is embedded in a seal groove that has a narrow width in which the longer tip seal is to be embedded, and thus a misassembly can be prevented. Accordingly, in a so-called "stepped scroll compressor" also, a situation in which a product whose performance is degraded due to misassembly of a tip seal is shipped can be reliably prevented, and thus reliability can be improved.

Furthermore, in any one of the aforementioned scroll compressors, tip seals that are embedded in tip surfaces of the inner circumferential side wrap of the fixed spiral wrap and the orbiting spiral wrap may be configured so that, relative to a tip seal that is embedded in the inner circumferential side wrap of the fixed spiral wrap, a tip seal that is embedded in the inner circumferential side wrap of the orbiting spiral wrap is formed to have a shorter length and a thicker thickness, or is formed to have a wider width.

By adopting such a configuration, among the tip seals that are embedded in the tip surfaces of the inner circumferential side wrap of the fixed spiral wrap and the orbiting spiral wrap, relative to a tip seal that is embedded in the inner circumferential side wrap of the fixed spiral wrap, a tip seal that is embedded in the inner circumferential side wrap of the orbiting spiral wrap is formed to have a shorter length and a thicker thickness, or is formed to have a wider width. Hence, when a tip seal that is embedded in the inner circumferential side wrap of the orbiting spiral wrap is formed to have a short length and a thick thickness, even if the relevant tip seal is mistakenly embedded in the seal groove of the inner circumferential side wrap of the fixed spiral wrap, the mistaken embedding can be detected as a misassembly when checking the rotational torque in the assembly process. Further, when a tip seal that is embedded in the inner circumferential side wrap of the orbiting spiral wrap is formed to have a wide width, a case does not occur in which the relevant tip seal is embedded in a seal groove with a long length and a narrow width of the inner circumferential side wrap of the fixed spiral wrap, and thus a misassembly can be prevented. Accordingly, it is possible to reliably prevent a situation in which a product whose performance is degraded due a tip seal being incorrectly assembled in an inner circumferential side wrap of a stepped scroll compressor is shipped, and thus reliability can be improved.

Further, in any one of the aforementioned scroll compressors, tip seals that are embedded in tip surfaces of the outer circumferential side wrap of the fixed spiral wrap and the orbiting spiral wrap may be configured so that, relative to a tip seal that is embedded in the outer circumferential side wrap of the orbiting spiral wrap, a tip seal that is embedded in the outer circumferential side wrap of the fixed spiral wrap is formed to have a shorter length and a thicker thickness, or is formed to have a wider width.

By adopting such a configuration, among the tip seals that are embedded in the tip surfaces of the outer circumferential side wrap of the fixed spiral wrap and the orbiting spiral wrap, relative to a tip seal that is embedded in the outer circumferential side wrap of the orbiting spiral wrap, a tip seal that is embedded in the outer circumferential side wrap of the fixed spiral wrap is formed to have a shorter length and a thicker thickness, or is formed to have a wider width. Hence, when a tip seal that is embedded in the outer circumferential side wrap of the fixed spiral wrap is formed to have a short length and a thick thickness, even if the relevant tip seal is mistakenly embedded in the seal groove of the outer circumferential side wrap of the orbiting spiral wrap, the mistaken embedding can be detected as a misassembly when checking the rotational torque in the assembly process. Further, when a tip seal that is embedded in the outer circumferential side wrap of the fixed spiral wrap is formed to have a wide width, a case does not occur in which the relevant tip seal is embedded in a seal groove that has a long length and a narrow width of the outer circumferential side wrap of the orbiting spiral wrap, and thus a misassembly can be prevented. Accordingly, it is possible to prevent a situation in which a product whose performance is degraded due a tip seal being incorrectly assembled in an outer circumferential side wrap of a stepped scroll compressor is shipped, and thus reliability can be improved.

Advantageous Effects of Invention

According to the present invention, a misassembly of a tip seal can be detected, or misassembly of a tip seal can be prevented. Hence, a situation in which a product whose performance is degraded due to misassembly of a tip seal is shipped can be reliably prevented, and thus reliability can be improved.

DESCRIPTION OF EMBODIMENTS

Embodiments of the present invention are described hereunder with reference to the drawings.

[First Embodiment]

A first embodiment of the present invention is described hereunder using FIG. 1 to FIG. 3B.

Figure 1:
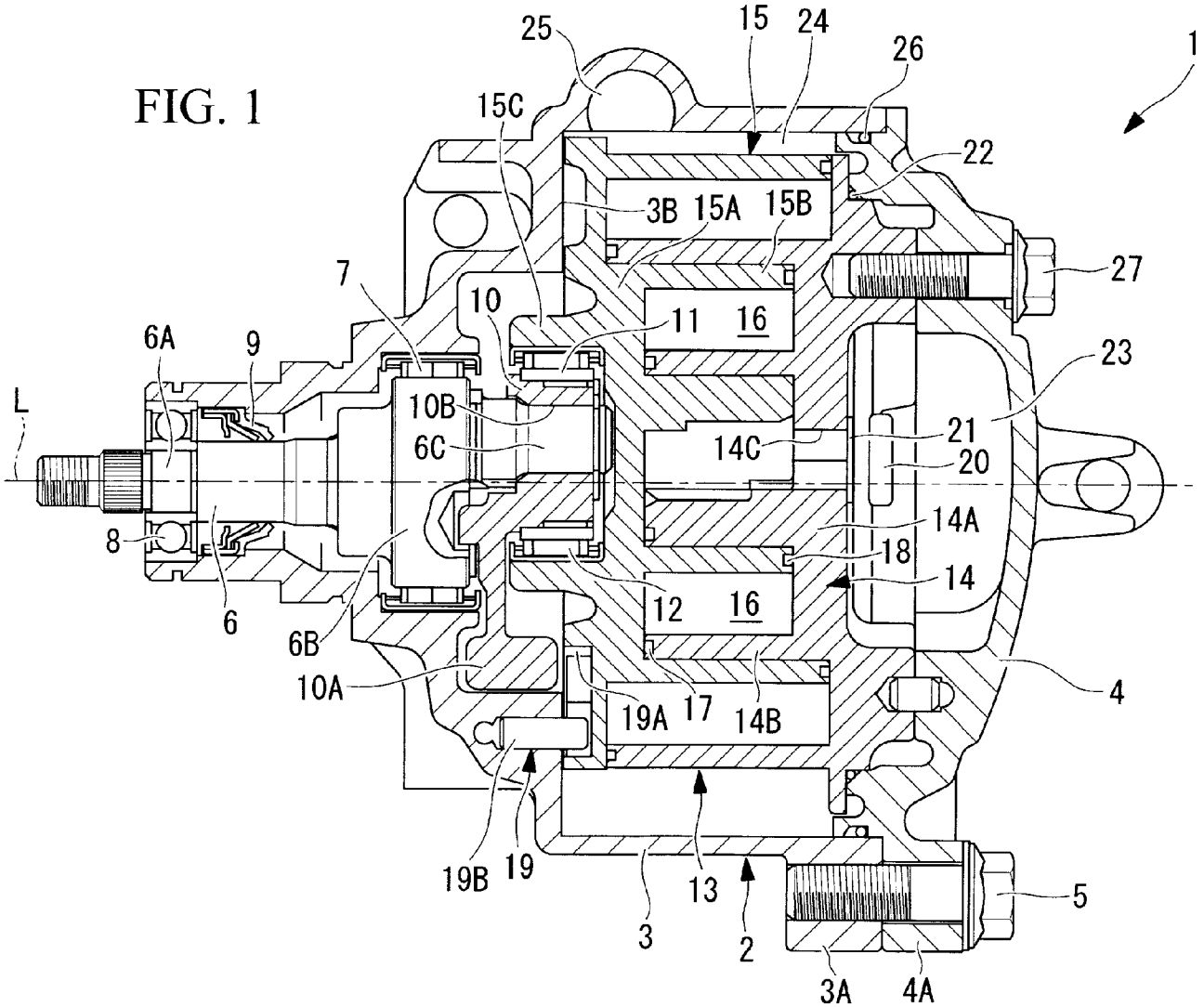
FIG. 1 is a longitudinal sectional view of a scroll compressor according to the first embodiment of the present invention.

FIG. 1 is a longitudinal sectional view of a scroll compressor according to the first embodiment of the present invention. A scroll compressor 1 has a housing 2 that constitutes an outer shell. The housing 2 is formed by integrally tightening and fastening together a front housing 3 and a rear housing 4 with bolts 5. Tightening flanges 3A and 4A are integrally formed at a plurality of positions, for example, four positions, at equal intervals on the circumference of the front housing 3 and the rear housing 4. The front housing 3 and rear housing 4 are integrally coupled by tightening the flanges 3A and 4A together with the bolts 5.

Inside the front housing 3, a crankshaft (driving shaft) 6 is rotatably supported around an axis line L thereof via a main bearing 7 and a sub-bearing 8. One end side (the left side in FIG. 1) of the crankshaft 6 serves as a small-diameter shaft portion 6A. The small-diameter shaft portion 6A penetrates the front housing 3 and projects to the left side in FIG. 1. An electromagnetic clutch, pulley and the like, which are not depicted in the drawings, that receive a motive force in a known manner are provided at a projecting portion of the small-diameter shaft portion 6A, and are configured so that a motive force is transmitted thereto via a V-belt or the like from a driving source such as an engine. A mechanical seal (lip seal) 9 is arranged between the main bearing 7 and the sub-bearing 8 to provide an airtight seal between the inside of the housing 2 and the atmosphere.

A large-diameter shaft portion 6B is provided on another end side (the right side in FIG. 1) of the crankshaft 6. A crank pin 6C is integrally provided in the large-diameter shaft portion 6B in a state in which the crank pin 6C is eccentric relative to the axis line L of the crankshaft 6 by a predetermined dimension. The crankshaft 6 is rotatably supported as a result of the large-diameter shaft portion 6B and the small-diameter shaft portion 6A being supported by the front housing 3 via the main bearing 7 and the sub-bearing 8. An orbiting scroll 15 that is described later is connected to the crank pin 6C via a drive bush 10, a cylindrical ring (floating bush) 11, and a drive bearing 12 so that the orbiting scroll 15 is driven in an orbital motion by rotation of the crankshaft 6.

A balance weight 10A for canceling an unbalanced load that occurs as a result of the orbital driving of the orbiting scroll 15 is formed integrally with the drive bush 10 so as to orbit together with the orbital driving of the orbiting scroll 15. A crank pin hole 10B in which the crank pin 6C fits is provided in the drive bush 10 at an eccentric position relative to the center thereof. Thus, a known driven crank mechanism is constituted in which the drive bush 10 in which the crank pin 6C is fitted and the orbiting scroll 15 receive a reactive force of gas compression and are rotated around the crank pin 6C, and in which an orbiting radius of the orbiting scroll 15 is variable.

A scroll compression mechanism 13 that is constituted by a pair of a fixed scroll 14 and an orbiting scroll 15 is built inside the housing 2. The fixed scroll 14 is composed by a fixed end plate 14A and a fixed spiral wrap 14B that is erected on the fixed end plate 14A. The orbiting scroll 15 is composed by an orbiting end plate 15A and an orbiting spiral wrap 15B that is erected on the orbiting end plate 15A.

In the above described fixed scroll 14 and orbiting scroll 15, step portions 14D and 14E and step portions 15D and 15E (see FIG. 2A and FIG. 2B) are provided, respectively, at predetermined positions in the spiral direction of a tip surface and a bottom surface of the respective spiral wraps 14B and 15B. Taking the step portions 14D and 14E, and 15D and 15E as boundaries, with respect to the tip surfaces of the wraps, the tip surface of the outer circumferential side in the orbit axis direction is high and the tip surface of the inner circumferential side is low. Further, with respect to the bottom surfaces of the wraps, the bottom surface of the outer circumferential side in the orbit axis direction is low and the bottom surface of the inner circumferential side is high. As a result, in each of the spiral wraps 14B and 15B, the wrap height on the outer circumferential side is higher than the wrap height on the inner circumferential side.

The fixed scroll 14 and the orbiting scroll 15 are assembled so that their respective centers are separated from each other by a distance corresponding to the amount of the orbiting radius, and so as to be fitted with each other in a condition in which the phases of the respective spiral wraps 14B and 15B are shifted by 180 degrees, and also to have a slight clearance (from several tens to several hundreds of microns) in the wrap height direction at ordinary temperature between the tip surfaces and bottom surfaces of the spiral wraps 14B and 15B. As a result, as shown in FIG. 1, a plurality of pairs of compression chambers 16 that are limited by the end plates 14A and 15A and the spiral wraps 14B and 15B are formed between the two scrolls 14 and 15 with point symmetry with respect to the scroll center, and are configured so that the orbiting scroll 15 can smoothly orbit around the fixed scroll 14.

In the compression chambers 16, the height in the orbit axis direction at the outer circumferential side of the spiral wraps 14B and 15B is arranged to be higher than the height of the inner circumferential side. This contributes to form the scroll compression mechanism 13 that is capable of three-dimensional compression that can compress a gas in both a circumferential direction and a height direction of the respective spiral wraps 14B and 15B. Tip seals 17 and 18, described later, that seal tip clearances formed between the tip surfaces of the spiral wraps 14B and 15B of the fixed scroll 14 and the orbiting scroll 15 and the bottom surfaces of the opposing scroll are fitted and embedded into seal grooves 14F and 14G, and 15F and 15G that are provided in the respective tip surfaces.

The fixed scroll 14 is fixedly arranged via a bolt 27 on an inner face of the rear housing 4. Further, the orbiting scroll 15 is configured so that, as described above, the crank pin 6C that is provided on one end side of the crankshaft 6 is connected via the drive bush 10, the cylindrical ring (floating bush) 11, and the drive bearing 12 to a boss portion 15C provided on a rear face of the orbiting end plate 15A, so that the orbiting scroll 15 is driven in an orbital motion.

The orbiting scroll 15 is configured so that the rear face of the orbiting end plate 15A is supported by a thrust receiving surface 3B of the front housing 3, and so as to be driven in a rotational orbital motion around the fixed scroll 14 while self-rotation thereof is being prevented via a self-rotation preventing mechanism 19 that is provided between the thrust receiving surface 3B and the rear face of the orbiting end plate 15A. The self-rotation preventing mechanism 19 of the present embodiment is arranged as a pin-and-ring type self-rotation preventing mechanism 19 in which a self-rotation prevention pin 19B that is embedded in a pin hole provided in the front housing 3 is fitted in a slidable manner in an inner circumferential face of a self-rotation prevention ring 19A that is embedded in a ring hole provided in the orbiting end plate 15A of the orbiting scroll 15.

A discharge port 14C for discharging a compressed refrigerant gas is formed in a central portion of the fixed end plate 14A of the fixed scroll 14, and a discharge reed valve 21 that is mounted to the fixed end plate 14A via a retainer 20 is arranged in the discharge port 14C. A seal material 22 such as an O-ring is provided on the rear face side of the fixed end plate 14A so as to closely contact an inner face of the rear housing 4, and forms a discharge chamber 23 that is partitioned from the internal space of the housing 2 between the seal material 22 and the inner face of the rear housing 4. Thus, the internal space of the housing 2 excluding the discharge chamber 23 is configured to function as an intake chamber 24.

The intake chamber 24 takes in refrigerant gas returning from the refrigeration cycle through an intake port 25 provided in the front housing 3, and the refrigerant gas is taken into the compression chamber 16 through the intake chamber 24. A seal material 26 such as an O-ring is provided at the joint surface between the front housing 3 and the rear housing 4, to thereby seal the intake chamber 24 that is formed in the housing 2 from the atmosphere in an airtight manner.

Figure 2A:
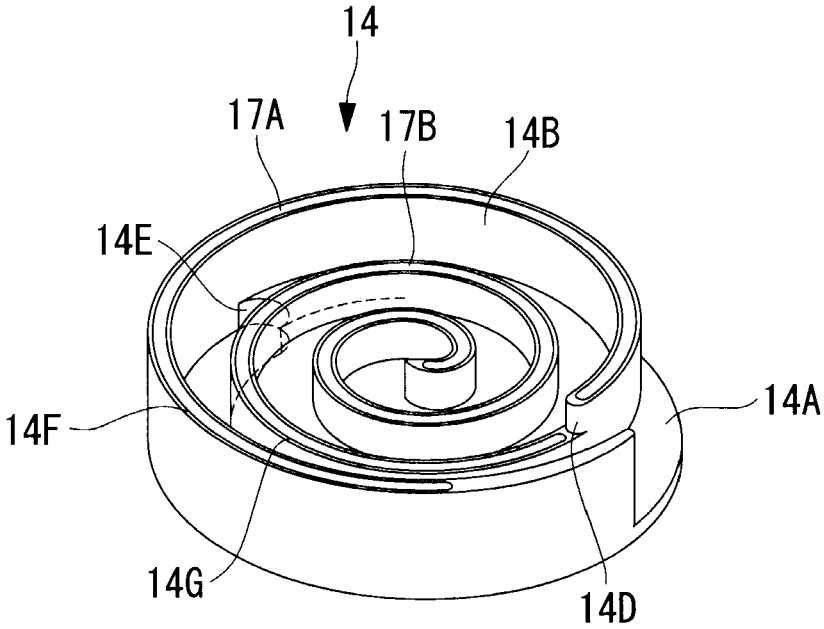
FIG. 2A is a perspective view of a fixed scroll that is applied to the scroll compressor shown in FIG. 1.
Figure 2B:
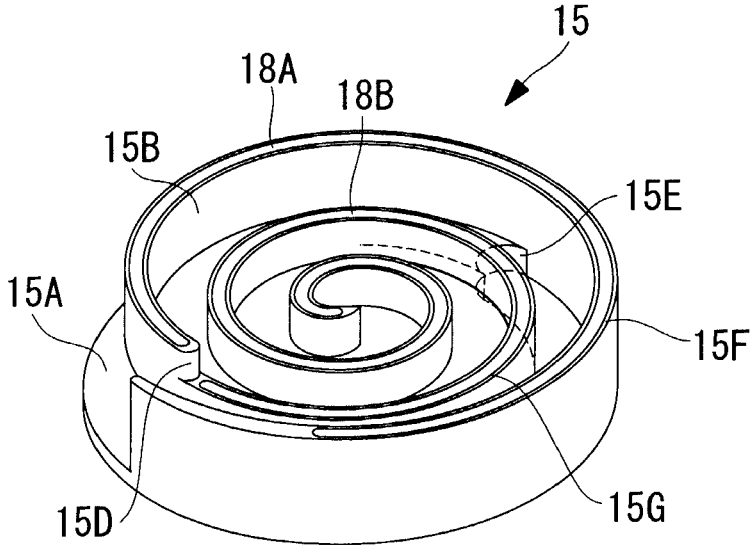
FIG. 2B is a perspective view of an orbiting scroll that is applied to the scroll compressor shown in FIG. 1.

As shown in FIG. 2A and FIG. 2B, taking the step portions 14D and 15D as boundaries, the tip seals 17 and 18 that are embedded in the tip surfaces of the fixed spiral wrap 14B and the orbiting spiral wrap 15B are respectively divided into tip seals 17A and 18A that are embedded in the seal grooves 14F and 15F provided in the tip surfaces of the respective outer circumferential side wraps, and tip seals 17B and 18B that are embedded in the seal grooves 14G and 15G provided in the tip surfaces of the respective inner circumferential side wraps. The aforementioned tip seals 17A, 17B, 18A, and 18B are embedded so as to fit in the respective seal grooves 14F, 14G, 15F and 15G. The tip seals 17A and 17B that are embedded in the fixed scroll 14 and the tip seals 18A and 18B that are embedded in the orbiting scroll 15 are arranged as described below.

Figure 3A:
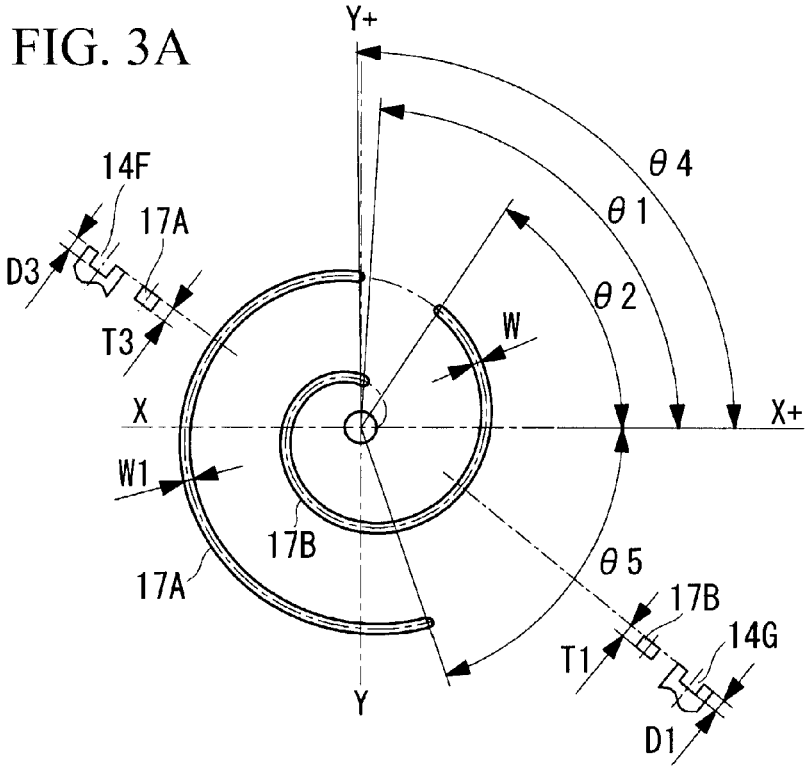
FIG. 3A is a plan view of a tip seal for a fixed scroll that is applied to the scroll compressor shown in FIG. 1.
Figure 3B:
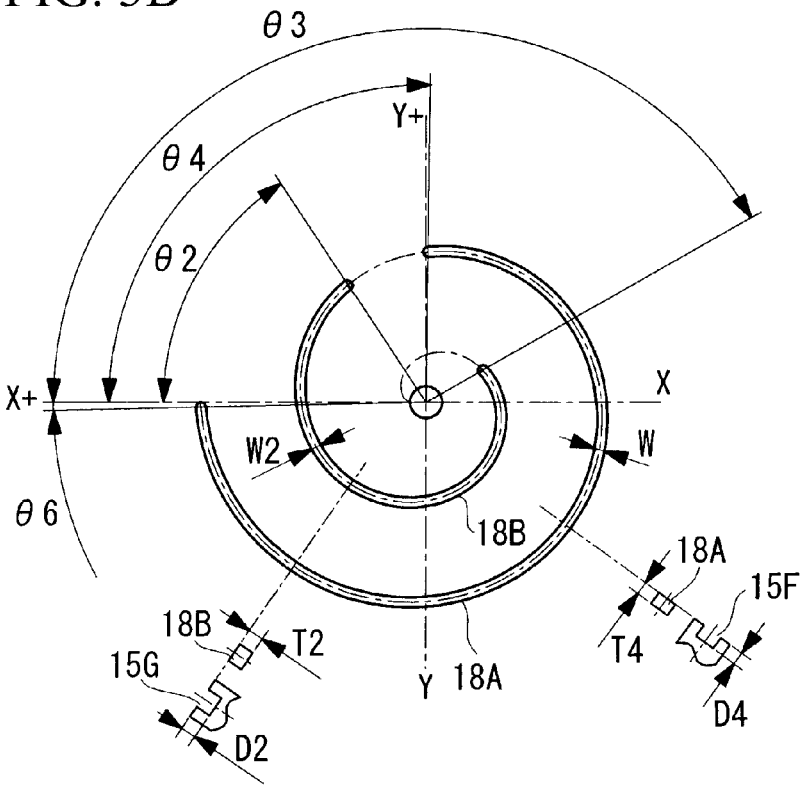
FIG. 3B is a plan view of a tip seal for an orbiting scroll that is applied to the scroll compressor shown in FIG. 1.

With respect to the tip seal 17B and the tip seal 18B that are embedded at positions that are further on the inner circumferential side than the step portions 14D and 15D, as shown in FIG. 3A and FIG. 3B, the length of the tip seal 17B of the fixed side is longer than the length of the tip seal 18B of the orbiting side. This is to prevent the inner circumferential end side of the tip seal 18B that is embedded in the orbiting scroll 15 from interfering with the discharge port 14C provided in the fixed scroll 14, and consequently the inner circumferential end side of the tip seal 18B is arranged to be shorter by a predetermined dimension. More specifically, when an X+ side of an X-axis of X-Y coordinates shown in FIG. 3A and FIG. 3B is taken as a reference, the length of the tip seal 17B of the fixed side is from an inner circumferential end position at an angle θ1 to an outer circumferential end position at an angle θ2, while the length of the tip seal 18B of the orbiting side is from an inner circumferential end position at an angle θ3 to an outer circumferential end position at the angle θ2. Thus, the length of the tip seal 18B is shorter than the length of the tip seal 17B by an amount corresponding to the amount by which the angle θ3 is greater than the angle θ1.

Therefore, although there is no possibility of the long tip seal 17B of the fixed side being embedded in the short seal groove 15G of the orbiting scroll 15 side, there is a possibility of the short tip seal 18B of the orbiting side being mistakenly embedded in the long seal groove 14G of the fixed scroll 14 side. Thus, to prevent such kind of misassembly, a thickness T2 of the short tip seal 18B of the orbiting side is made thicker than a thickness T1 of the long tip seal 17B of the fixed side (T1<T2), and the respective seal grooves 14G and 15G are arranged so as to have different depths D1 and D2 that correspond to the thicknesses T1 and T2 of the tip seals 17B and 18B. Thus, if the tip seal 18B of the orbiting side is mistakenly embedded in the seal groove 14G on the fixed side, the mistaken embedding can be detected as a misassembly when checking the rotational torque in the assembly process.

Likewise, with respect to the tip seal 17A and tip seal 18A that are embedded at positions that are further on the outer circumferential side than the step portions 14D and 15D, as shown in FIG. 3A and FIG. 3B, the length of the tip seal 18A of the orbiting side is longer than the length of the tip seal 17A of the fixed side. This is prevent the outer circumferential end side of the tip seal 17A that is embedded in the fixed scroll 14 from interfering with an outer circumference of the end plate 15A of the orbiting scroll 15 whose outer diameter is reduced, and consequently the outer circumferential end side of the tip seal 17A is arranged to be shorter by a predetermined dimension. More specifically, when the X+ side of the X-axis of the X-Y coordinates shown in FIG. 3A and FIG. 3B is taken as a reference, the length of the tip seal 17A of the fixed side is from an inner circumferential end position at an angle θ4 to an outer circumferential end position at an angle θ5, while the length of the tip seal 18A of the orbiting side is from an inner circumferential end position at the angle θ4 to an outer circumferential end position at the angle θ6. Thus, the length of the tip seal 17A is shorter than the length of the tip seal 18A by an amount corresponding to the amount by which the angle θ5 is greater than the angle θ6.

Therefore, although there is no possibility of the long tip seal 18A of the orbiting side being embedded in the short seal groove 14F of the fixed scroll 14 side, there is a possibility of the short tip seal 17A of the fixed side being mistakenly embedded in the long seal groove 15F of the orbiting scroll 15 side. Thus, to prevent such kind of misassembly, a thickness T3 of the short tip seal 17A of the fixed side is made thicker than a thickness T4 of the long tip seal 18A of the orbiting side (T3>T4), and the respective seal grooves 14F and 15F are arranged so as to have different depths D3 and D4 that correspond to the thicknesses T3 and T4 of the tip seals 17A and 18A. Thus, if the tip seal 17A of the fixed side is mistakenly embedded in the seal groove 15F on the orbiting side, the mistaken embedding can be detected as a misassembly when checking the rotational torque in the assembly process.

In this connection, it is sufficient that, relative to the thicknesses T1 and T4 of the tip seals 17B and 18A, the thicknesses T2 and T3 of the tip seals 17A and 18B are made approximately 0.2 to 0.4 mm thicker, and are arranged to contact the bottom surface of the opposing scroll in an assembled state.

By adopting the above described configuration, the present embodiment provides the following advantage.

When a rotational driving force from an external driving source is transmitted to the crankshaft 6 via an unshown pulley and electromagnetic clutch, and causes the crankshaft 6 to rotate, the the orbiting scroll 15 that is connected to the crank pin 60 of the crankshaft 6 through the drive bush 10, the cylindrical ring (floating bush) 11, and the drive bearing 12 such that the orbiting radius of the the orbiting scroll 15 is variable is driven in a rotational orbital motion with a predetermined orbiting radius around the fixed scroll 14 while self-rotation thereof is being prevented by the pin-and-ring type self-rotation preventing mechanism 19.

As a result of the orbiting scroll 15 being driven in a rotational orbital motion, a refrigerant gas inside the intake chamber 24 is drawn into the pair of compression chambers 16 that are formed at the outermost circumference in the radial direction. After the intake into the compression chamber 16 is cut off at a position at a predetermined orbital angle, the compression chamber 16 is moved towards the center side while the capacity thereof is being reduced in a circumferential direction and a wrap height direction. The refrigerant gas is compressed during this time, and when the compression chamber 16 reaches a position that communicates with the discharge port 14C, the discharge reed valve 21 is pushed open. As a result, compressed gas that has a high temperature and a high pressure is discharged into the discharge chamber 23, and is sent to outside of the scroll compressor 1 through the discharge chamber 23.

During the above compression operation, the tip seals 17A and 17B that are embedded in the seal grooves 14F and 14G provided in the tip surface of the fixed spiral wrap 14B seal a tip clearance between the tip surface of the fixed spiral wrap 14B and the bottom surface of the orbiting spiral wrap 15B to thereby reduce the leakage of gas. The tip seals 18A and 18B that are embedded in the seal grooves 15F and 15G provided in the tip surface of the orbiting spiral wrap 15B seal a tip clearance between the tip surface of the orbiting spiral wrap 15B and the bottom surface of the fixed spiral wrap 14B to thereby reduce the leakage of gas. Therefore, although the compression efficiency is improved, if the tip seals are incorrectly assembled the sealing function will be lost and the leakage of gas will increase, and hence the compression performance will decline.

According to the present embodiment, the thicknesses T3 and T2 of the short tip seals 17A and 18B are made thicker than the thicknesses T4 and T1 (T3>T4, Tl<T2) of the long tip seals 18A and 17B. Thus, even in the event that the tip seals 17A and 18B are mistakenly embedded in the seal grooves 15F and 14G, the tip seals 17A and 18B will protrude from the seal grooves 15F and 14G and contact with the bottom surface of the opposing scroll.

Therefore, even in the event that the tip seals 17A and 18B that are to be embedded in the tip surface of a wrap that is positioned further on an inner circumferential side and the tip surface of a wrap that is positioned further on an outer circumferential side, respectively, than the respective step portions 14D and 15D of the fixed spiral wrap 14B of the fixed scroll 14 and the orbiting spiral wrap 15B of the orbiting scroll 15 are mistakenly embedded, the tip seals 17A and 18B will contact the bottom surface of the opposing scroll and the rotational torque will increase. Hence, it is possible to detect the mistaken embedding as a misassembly when checking the rotational torque in the assembly process. Accordingly, a situation in which a product whose performance is degraded due to misassembly of the tip seals 17A and 18B is shipped can be reliably prevented, and thus reliability can be improved.

[Second Embodiment]

Next, a second embodiment of the present invention is described with reference to FIG. 3A and FIG. 3B.

The present embodiment differs from the above described first embodiment in the respect that the tip seals 17A and 18B that are arranged to have a shorter length are configured to have wider widths W1 and W2 relative to the tip seals 17A and 18B of the first embodiment. The remaining configuration of the present embodiment is the same as in the first embodiment, and hence a description thereof is omitted below.

According to the present embodiment, a configuration is adopted in which the widths W1 and W2 of the tip seals 17A and 18B that are arranged to have a shorter length are made wider than a width W (W1>W, W2>W) of the tip seals 17B and 18A that are arranged to have a longer length. Further, the widths of the seal grooves 14F and 15G into which the tip seals 17B and 18A are embedded are arranged to correspond with the widths W1 and W2 of the tip seals 17B and 18A and to be different from the widths of the seal grooves 14G and 15F.

In this connection, it is sufficient for a difference in dimension between the above described width W and widths W1 and W2 to be a difference of an extent such that the tip seals 17B and 18A that have the widths W1 and W2 can not be fitted in the seal grooves 14G and 15F into which the tip seals 17B and 18A that have the width W are embedded. Specifically, a difference in dimension of approximately 0.1 mm is adequate.

Thus, the width W1 of the short tip seal 17A that is to be embedded in the tip surface of the wrap that is positioned further on the outer circumferential side than the step portion 14D of the fixed spiral wrap 14B is made wider than the width W of the tip seal 18A of the orbiting side. Hence, a case does not occur in which the tip seal 17A is embedded in the seal groove 15F that has a long length and a narrow width that is provided in the tip surface of the wrap that is positioned further on the outer circumferential side than the step portion 15D of the orbiting spiral wrap 15B, and thus a misassembly can be prevented.

Likewise, the width W2 of the short tip seal 18B that is to be embedded in the tip surface of the wrap that is positioned further on the inner circumferential side than the step portion 15D of the orbiting spiral wrap 15B is made wider than the width W of the tip seal 17B of the fixed side. Hence, a case does not arise in which the tip seal 18B is embedded in the seal groove 14G that has a long length and a narrow width that is provided in the tip surface of the wrap that is positioned further on the inner circumferential side than the step portion 14D of the fixed spiral wrap 14B, and thus a misassembly can be prevented.

Accordingly, with respect to the stepped scroll compressor 1, it is possible to reliably prevent a situation in which a product is shipped whose performance has been degraded due to the tip seals 18B and 17A being misassembled in the wrap that is positioned further on the inner circumferential side and the wrap that is positioned further on the outer circumferential side than the step portions 14D and 15D, respectively, and thus the reliability can be improved.

The present invention is not limited to the invention according to the above described embodiments, and suitable modifications can be made in a range that does not depart from the spirit and scope of the invention. For example, although an example in which the present invention is applied to a so-called stepped scroll compressor 1 is described in the foregoing embodiments, naturally the invention may be similarly applied to a conventional scroll compressor that does not have a step portion. In such a scroll compressor, although a step portion is not provided in the fixed scroll and the orbiting scroll, and the tip seals are also formed as a single piece, in some cases tip seals are used whose lengths differ between the fixed side and the orbiting side.

That is, on the same X-Y coordinates as are shown in FIG. 3A and FIG. 3B, there are cases in which tip seals are used whose lengths differ between the fixed side and the orbiting side as a result of adopting a configuration in which the inner circumferential end positions of a fixed side tip seal and an orbiting side tip seal are at the same angle and the outer circumferential end positions thereof are at different angles. There are also cases in which tip seals are used whose lengths differ between the fixed side and the orbiting side as a result of adopting a configuration in which the inner circumferential end positions thereof are at different angles and the outer circumferential end positions thereof are at the same angle. In such cases, since there is a possibility that a shorter tip seal will be mistakenly embedded in a seal groove in which a long tip seal is to be embedded, by providing the shorter tip seal with a thick thickness or a wide width, it is possible to prevent a misassembly or to detect a misassembly in a similar manner to the above described embodiments, and a situation in which a product whose performance has been degraded due to misassembly of a tip seal is shipped can be reliably prevented.

Although according to the above embodiments an example is described in which the present invention is applied to an open-type scroll compressor that is driven by receiving a driving force from outside, naturally the present invention can be similarly applied to a hermetic or semi-hermetic scroll compressor that has a built-in electric motor as a driving source. Furthermore, although the constituent material of the tip seals 17 and 18 is not particularly restricted, carbon fiber-reinforced PTFE or the like is favorably used.

REFERENCE SIGNS LIST

1 scroll compressor
14 fixed scroll
14B fixed spiral wrap
14D, 14E step portion
14F, 14G seal groove
15 orbiting scroll
15B orbiting spiral wrap
15D, 15E step portion
15F, 15G seal groove
17, 17A, 17B, 18, 18A, 18B tip seal
T1, T2, T3, T4 thickness of tip seal
D1, D2, D3, D4 depth of seal groove
W, W1, W2 width of tip seal

The invention claimed is:

1. A scroll compressor in which a first tip seal formed as a single piece is embedded in a tip surface of a fixed spiral wrap of a fixed scroll and in which a second tip seal formed as a single piece whose length is different from that of the first tip seal is embedded in a tip surface of an orbiting spiral wrap of an orbiting scroll, wherein, among the first tip seal and the second tip seal, a thickness of a shorter tip seal is made thicker than a thickness of a longer tip seal, and depths of seal grooves in which the respective tip seals are embedded are formed to different depths in correspondence with the thicknesses of the respective tip seals.

2. A scroll compressor in which a first tip seal formed as a single piece is embedded in a tip surface of a fixed spiral wrap of a fixed scroll and in which a second tip seal formed as a single piece whose length is different from that of the first tip seal is embedded in a tip surface of an orbiting spiral wrap of an orbiting scroll, wherein, among the first tip seal and the second tip seal, a width of a shorter tip seal is made wider than a width of a longer tip seal, and widths of seal grooves in which the respective tip seals are embedded are formed to different widths in correspondence with the widths of the respective tip seals.

3. A scroll compressor in which step portions are provided at predetermined positions in a spiral direction of a tip surface and a bottom surface of a fixed spiral wrap of a fixed scroll and an orbiting spiral wrap of an orbiting scroll, respectively, and taking the step portions as boundaries, a wrap height of an outer circumferential side is made higher than a wrap height of an inner circumferential side, and tip seals of different lengths are embedded in tip surfaces of the inner circumferential side wrap and outer circumferential side wrap of the respective spiral wraps, wherein, among the tip seals embedded in tip surfaces of the inner circumferential side wraps, a thickness of a shorter tip seal is made thicker than a thickness of a longer tip seal, and depths of seal grooves in which the respective tip seals are embedded are formed to different depths in correspondence with the thicknesses of the respective tip seals, and among the tip seals embedded in tip surfaces of the outer circumferential side wraps, a thickness of a shorter tip seal is made thicker than a thickness of a longer tip seal, and depths of seal grooves in which the respective tip seals are embedded are formed to different depths in correspondence with the thicknesses of the respective tip seals.

4. The scroll compressor according to claim 3, wherein among tip seals that are embedded in tip surfaces of the inner circumferential side wrap of the fixed spiral wrap and the orbiting spiral wrap, relative to a tip seal that is embedded in the inner circumferential side wrap of the fixed spiral wrap, a tip seal that is embedded in the inner circumferential side wrap of the orbiting spiral wrap is formed to have a shorter length and a thicker thickness.

5. The scroll compressor according to claim 3, wherein among tip seals that are embedded in tip surfaces of the outer circumferential side wrap of the fixed spiral wrap and the orbiting spiral wrap, relative to a tip seal that is embedded in the outer circumferential side wrap of the orbiting spiral wrap, a tip seal that is embedded in the outer circumferential side wrap of the fixed spiral wrap is formed to have a shorter length and a thicker thickness.

6. A scroll compressor in which step portions are provided at predetermined positions in a spiral direction of a tip surface and a bottom surface of a fixed spiral wrap of a fixed scroll and an orbiting spiral wrap of an orbiting scroll, respectively, and taking the step portions as boundaries, a wrap height of an outer circumferential side is made higher than a wrap height of an inner circumferential side, and tip seals of different lengths are embedded in tip surfaces of the inner circumferential side wrap and outer circumferential side wrap of the respective spiral wraps, wherein, among the tip seals embedded in tip surfaces of the inner circumferential side wraps, a width of a shorter tip seal is made wider than a width of a longer tip seal, and widths of seal grooves in which the respective tip seals are embedded are formed to different widths in correspondence with the widths of the respective tip seals, and among the tip seals embedded in tip surfaces of the outer circumferential side wraps, a width of a shorter tip seal is made wider than a width of a longer tip seal, and widths of seal grooves in which the respective tip seals are embedded are formed to different widths in correspondence with the widths of the respective tip seals.

7. The scroll compressor according to claim 6, wherein among tip seals that are embedded in tip surfaces of the inner circumferential side wrap of the fixed spiral wrap and the orbiting spiral wrap, relative to a tip seal that is embedded in the inner circumferential side wrap of the fixed spiral wrap, a tip seal that is embedded in the inner circumferential side wrap of the orbiting spiral wrap is formed to have a shorter length and a thicker thickness, or is formed to have a wider width.

8. The scroll compressor according to claim 6, wherein among tip seals that are embedded in tip surfaces of the outer circumferential side wrap of the fixed spiral wrap and the orbiting spiral wrap, relative to a tip seal that is embedded in the outer circumferential side wrap of the orbiting spiral wrap, a tip seal that is embedded in the outer circumferential side wrap of the fixed spiral wrap is formed to have a shorter length and a wider width.

* * * * *